US006073783A

United States Patent [19]

Allman

[11] Patent Number: 6,073,783

[45] Date of Patent: Jun. 13, 2000

[54] DRYING RACK FOR ATHLETIC EQUIPMENT

[76] Inventor: Michael X. Allman, 300 Curley Dr., Orchard Park, N.Y. 14127

[21] Appl. No.: 09/173,259

[22] Filed: Oct. 14, 1998

[51] Int. Cl.[7] ..... A47F 7/24

[52] U.S. Cl. ..... 211/85.3; 211/85.7

[58] Field of Search ..... 211/85.7, 195, 211/13.1, 85.3, 149, 150, 85.24, 85.25, 119.006, 116, 173, 174, 175, 189, 190, 198, 201, 207, 171

[56] References Cited

U.S. PATENT DOCUMENTS

| | | | |
|---|---|---|---|
| 19,772 | 3/1858 | Hamilton | 211/171 X |
| 649,330 | 5/1900 | Martin | 211/174 |
| 1,752,985 | 4/1930 | Huffman | 211/181.1 X |
| 2,434,800 | 1/1948 | Hollander | 211/149 X |
| 3,168,329 | 2/1965 | Goldschmidt | 211/195 X |
| 3,189,380 | 6/1965 | Reguitti | 211/195 X |
| 4,320,817 | 3/1982 | Knoke et al. | 182/126 |
| 4,502,564 | 3/1985 | Kummerlin et al. | 182/161 |
| 4,858,633 | 8/1989 | Yang | 135/75 X |
| 5,507,399 | 4/1996 | Hermanson | 211/198 X |

*Primary Examiner*—Daniel P. Stodola
*Assistant Examiner*—Erica B. Harris
*Attorney, Agent, or Firm*—Simpson, Simpson & Snyder, L.L.P.

[57] ABSTRACT

An athletic equipment drying rack comprises a leg assembly which is operable between an open freestanding condition and a relatively more compact closed condition, and a torso assembly adjustably connected to the leg assembly. The torso assembly includes a transversely extending shoulder member, a pair of foldable arms, and a helmet member vertically extendable from the shoulder member. In a first embodiment, the torso assembly is pivotally connected to the leg assembly by a hinge for folding along a transversely extending axis between a drying position and a storage position. In a second embodiment, the torso assembly is connected to the leg assembly by a pair of vertical side rails engaging a transversely extending upper member of the leg assembly, whereby the torso assembly may be moved vertically relative to the leg assembly between a drying position and a storage position.

5 Claims, 8 Drawing Sheets

DRYING RACK FOR ATHLETIC EQUIPMENT

BACKGROUND

A. Field of the Invention

The present invention relates drying racks for a manner which encourages drying thereof by natural or forced air circulation, and more particularly to a novel freestanding drying rack for athletic equipment which adjusts to a compact shape for storage and/or transport purposes.

B. Description of the Prior Art

The problem of drying wet sports equipment, such as hockey or football equipment, is well known, particularly with respect to little league and scholastic athletics. Equipment strewn about the floor of a bedroom or living room is a common sight for parents of aspiring athletes, however the athletes themselves are typically oblivious to the negative olfactory and aesthetic ramifications of this ineffective drying technique. When travel is involved during which several games are played on a given trip, space limitations at a hotel, motel, or dormitory often do not allow this "floor spread" technique.

Applicant is unaware of any portable drying racks available to consumers for supporting athletic equipment, despite the observed need for such a product.

SUMMARY OF THE INVENTION

It is thus an object of the present invention to provide a rack for supporting a variety of athletic equipment and padding in a manner which permits air circulation throughout the equipment and padding for fast drying thereof.

It is another object of the present invention to provide a drying rack for athletic equipment which is readily and quickly adjustable to a compact condition when not in use so as to be easily stored and transported.

It is a further object of the present invention to provide a drying rack for athletic equipment which is lightweight and therefore may be carried with little effort.

It is a further object of the present invention to provide a drying rack for athletic equipment which does not have any detachable parts which may be lost.

In view of these and other objects, an athletic equipment drying rack formed in accordance with the present invention generally comprises a leg assembly which is operable between an open freestanding condition and a relatively more compact closed condition, and a torso assembly adjustably connected to the leg assembly. The leg assembly preferably includes an internal shelf, an external shelf, and cantilevered clip means. The torso assembly includes a transversely extending shoulder member, a pair of foldable arms, and a helmet member vertically extendable from the shoulder member. The torso assembly is movable between a drying position atop the leg assembly wherein the shoulder member is spaced apart vertically from the leg assembly, and a storage position characterized by the shoulder member being arranged adjacent to the leg assembly. In a first embodiment, the torso assembly is pivotally connected to the leg assembly by hinge means for folding along a transversely extending axis. In a second embodiment, the torso assembly is slidably connected to the leg assembly by a pair of side rails engaging a transversely extending upper member of the leg assembly.

BRIEF DESCRIPTION OF THE DRAWINGS

The nature and mode of operation of the present invention will now be more fully described in the following detailed description of the preferred embodiments taken with the accompanying drawing figures, in which.

DETAILED DESCRIPTION OF THE PREFERRED EMBODIMENTS

Figure 1:
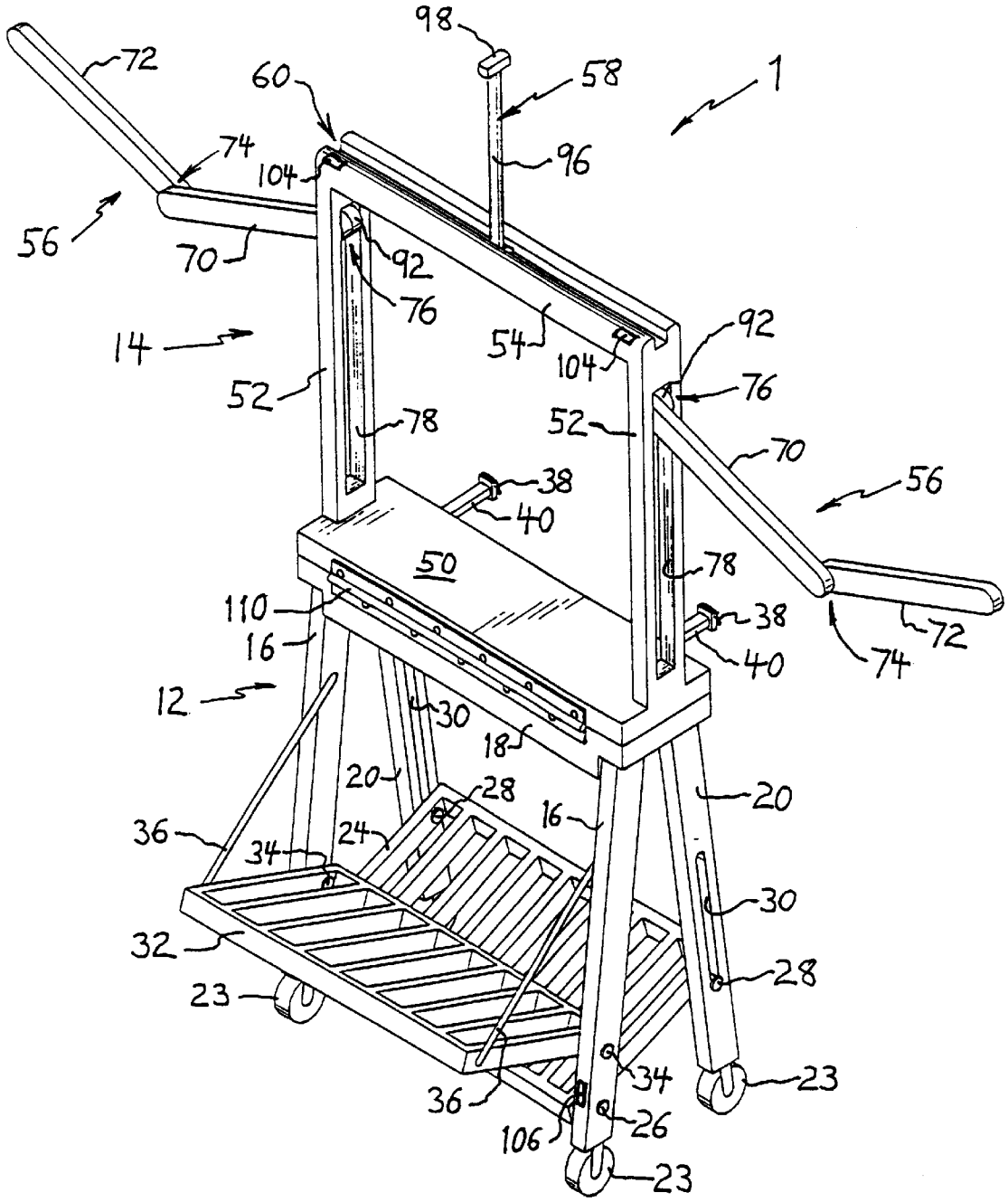
FIG. 1 is a perspective view of an athletic equipment drying rack formed in accordance with a first embodiment of the present invention.

Attention is directed initially to FIG. 1 of the drawings, wherein an athletic equipment drying rack formed in accordance with a first embodiment of the present invention is shown in use and designated generally by the reference numeral 1. Drying rack 1 is intended to support athletic equipment after use, especially hockey and football equipment, in a manner which facilitates drying thereof by either natural or forced air circulation. Moreover, drying rack 1 is of a novel construction which enables it to be adjusted to a more compact, generally planar shape for easy transport and storage. Accordingly, lightweight plastic is the preferred material for construction of the various equipment-supporting parts of drying rack 1 because it is durable, washable, moisture resistant, inexpensive, and makes the drying rack easy to carry.

Figure 2:
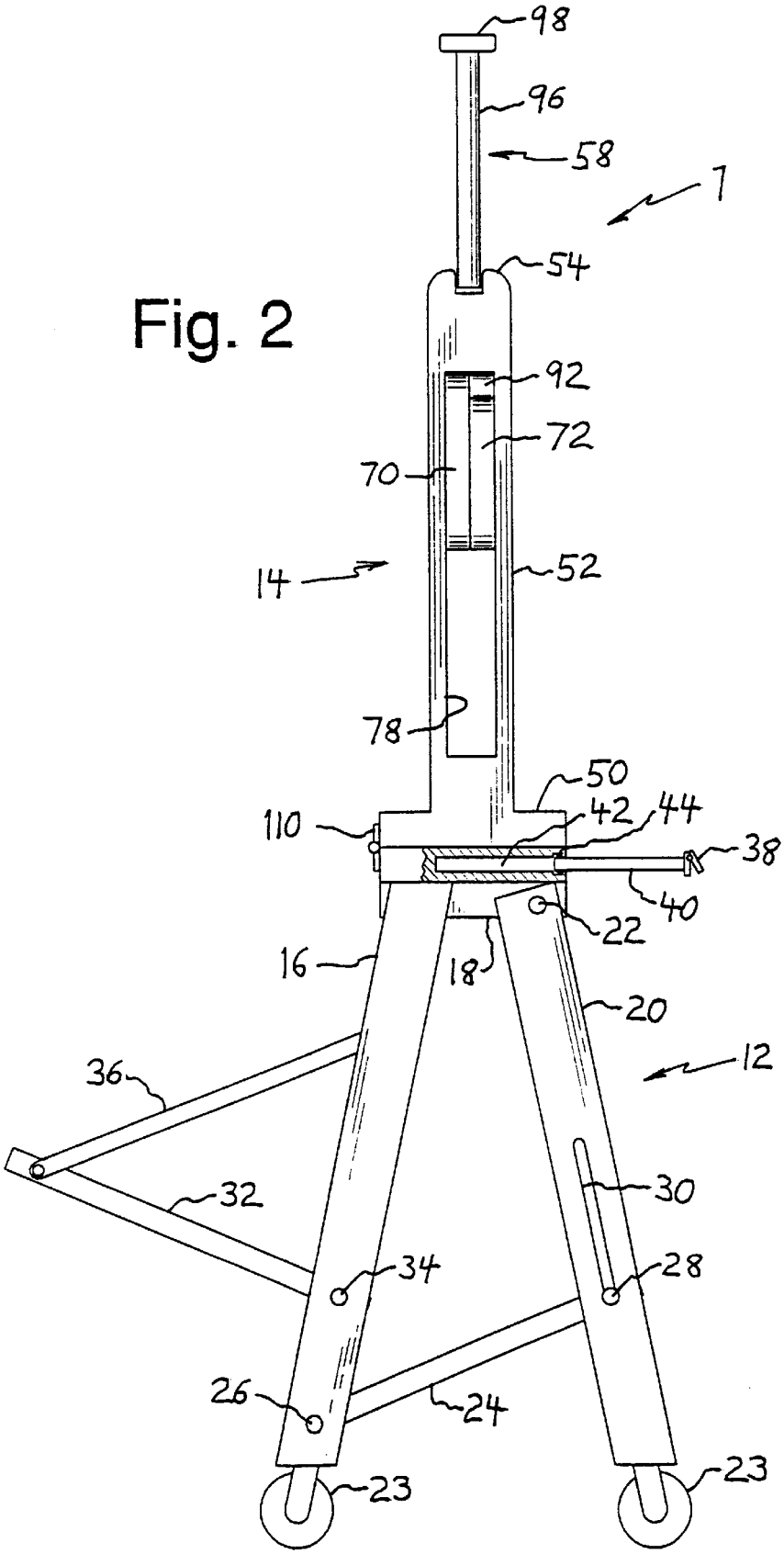
FIG. 2 is a side elevational view thereof.
Figure 3:
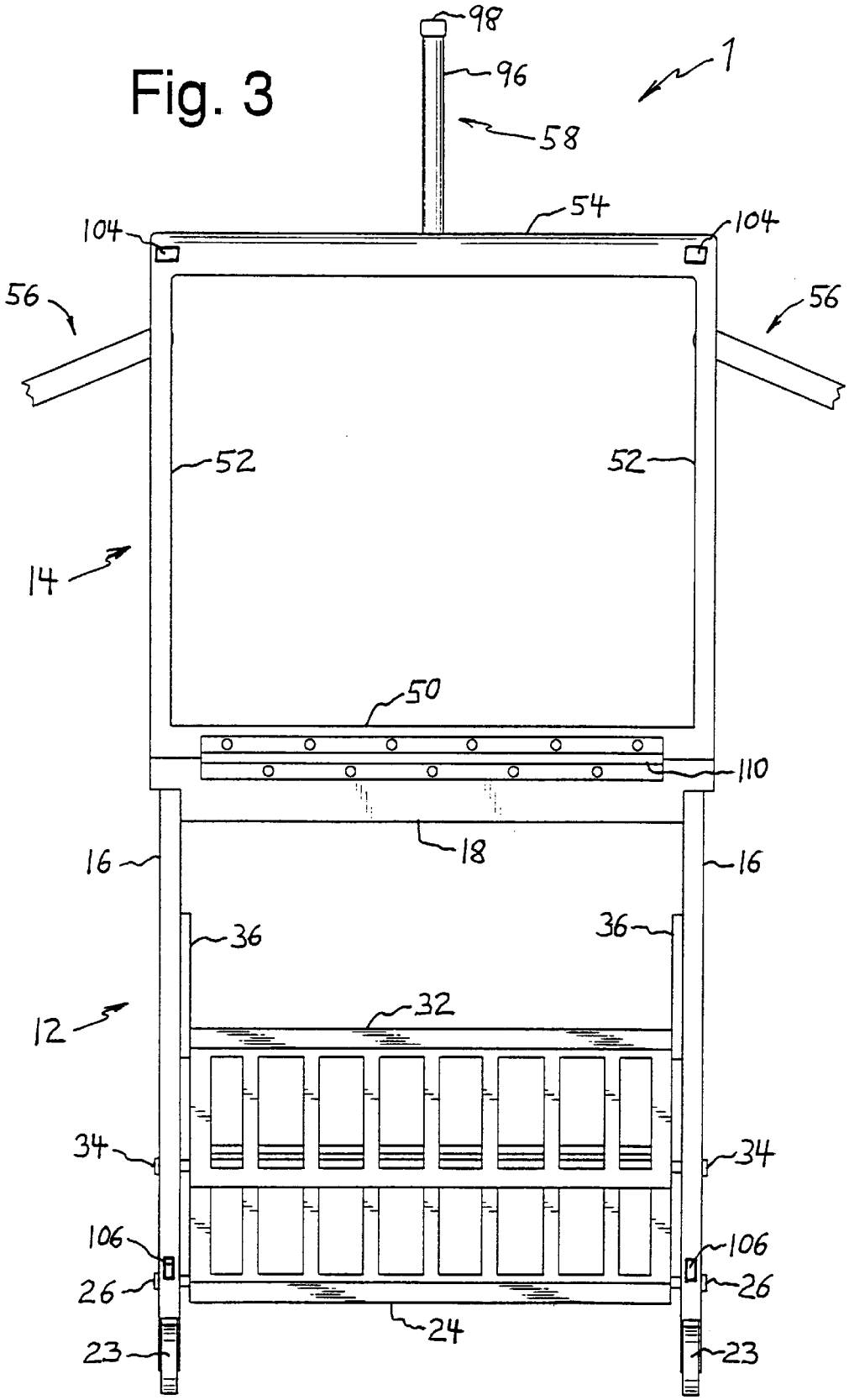
FIG. 3 is a front elevational view thereof.

Referring additionally now to FIGS. 2 and 3, drying rack 1 generally comprises a leg assembly 12 and a torso assembly 14 adjustably connected to the leg assembly.

Figure 6:
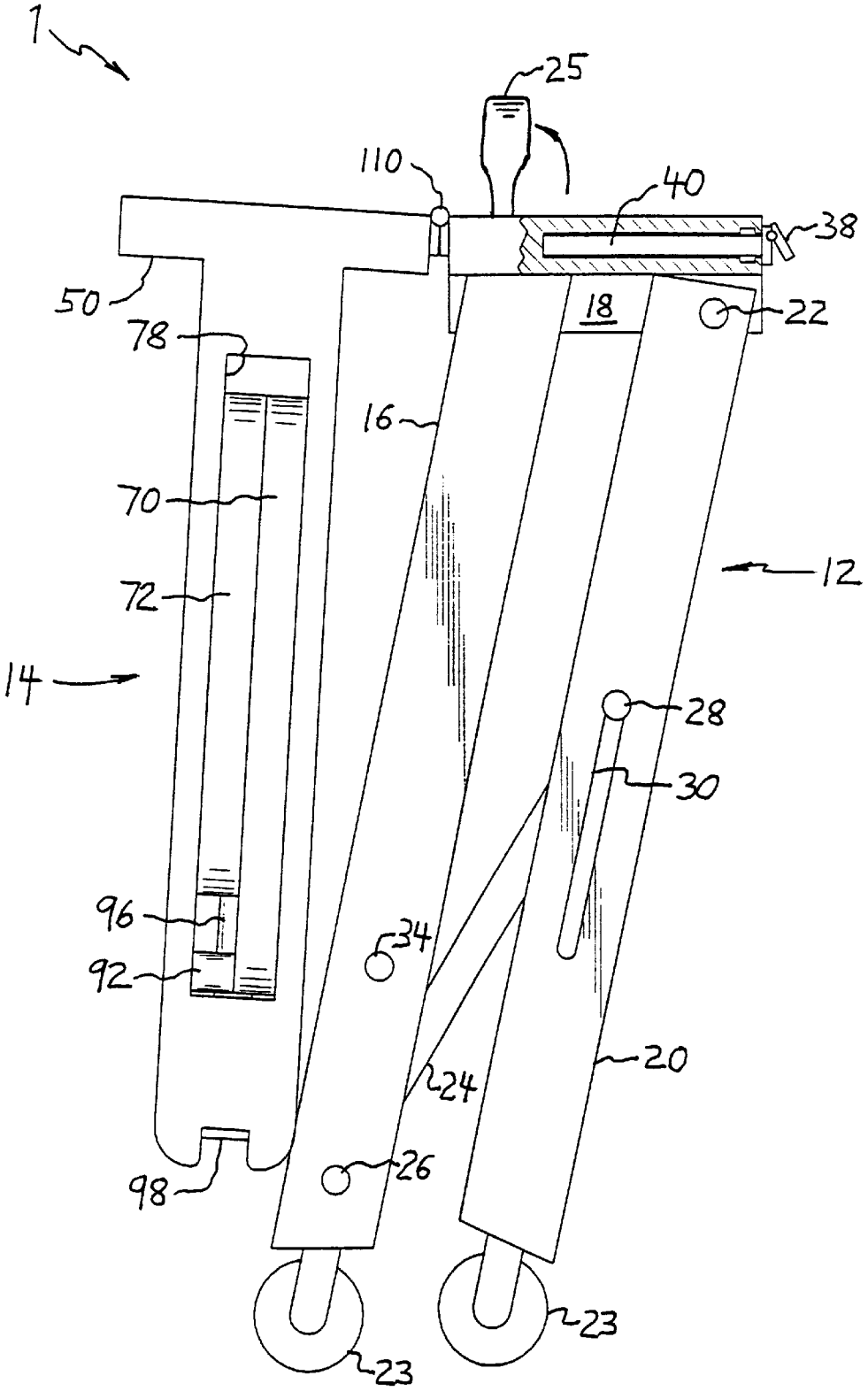
FIG. 6 is a side elevational view of the drying rack according to the first embodiment, shown adjusted for storage or transport.
Figure 7:
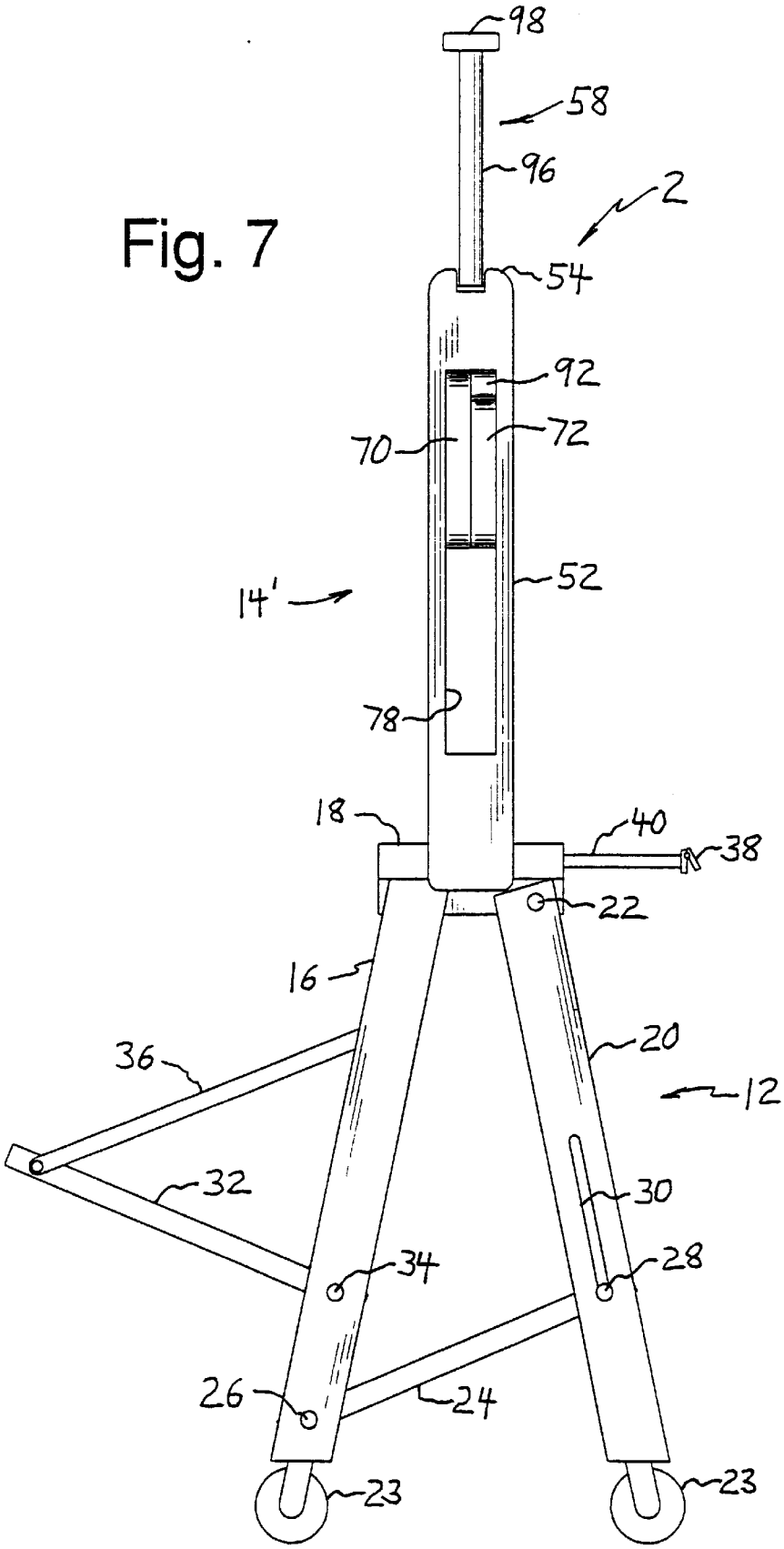
FIG. 7 is a side elevational view of a drying rack formed in accordance with a second embodiment of the present invention, showing the drying rack in a drying position.
Figure 8:
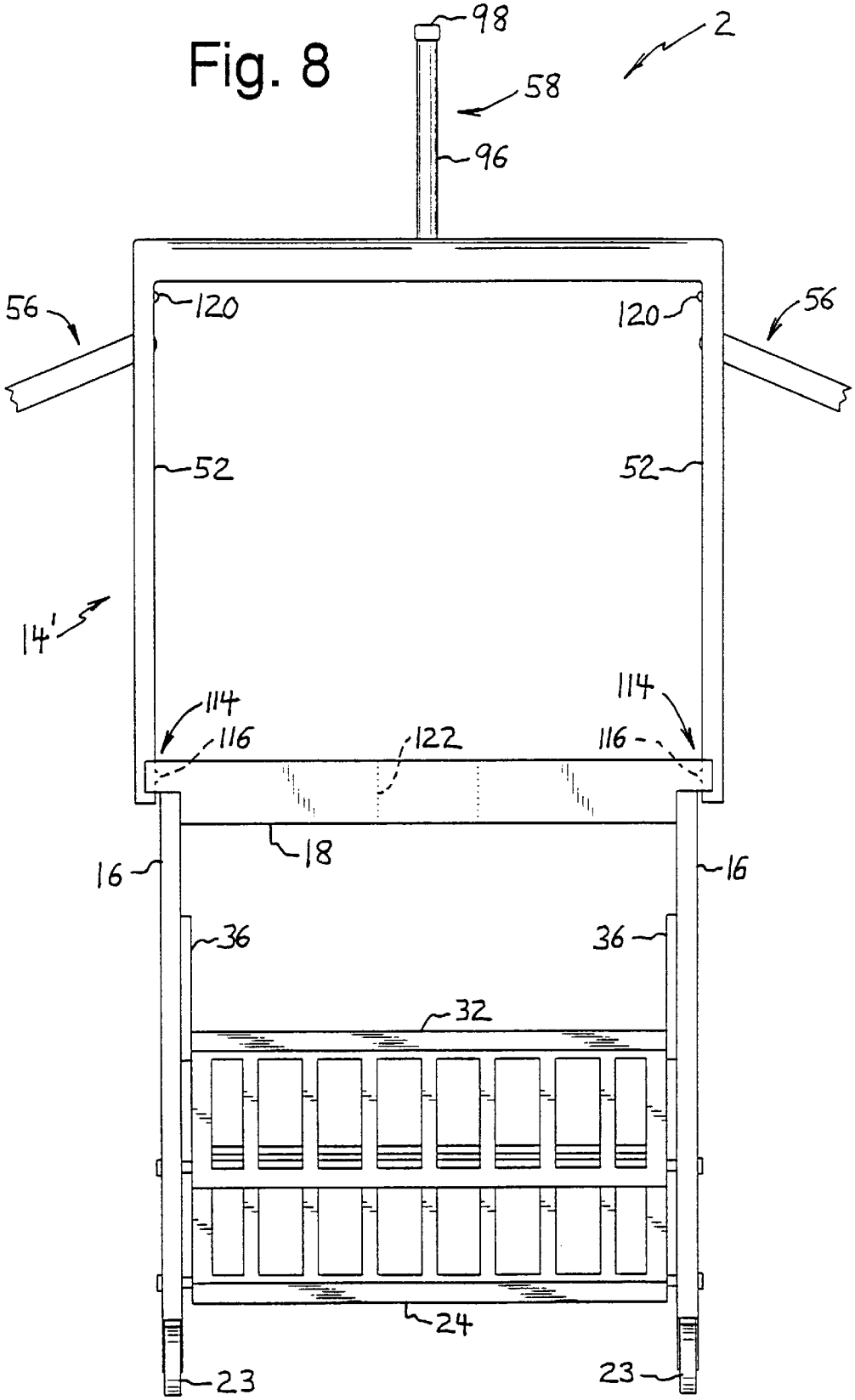
FIG. 8 is a front elevational view of the drying rack shown in FIG. 7.
Figure 9:
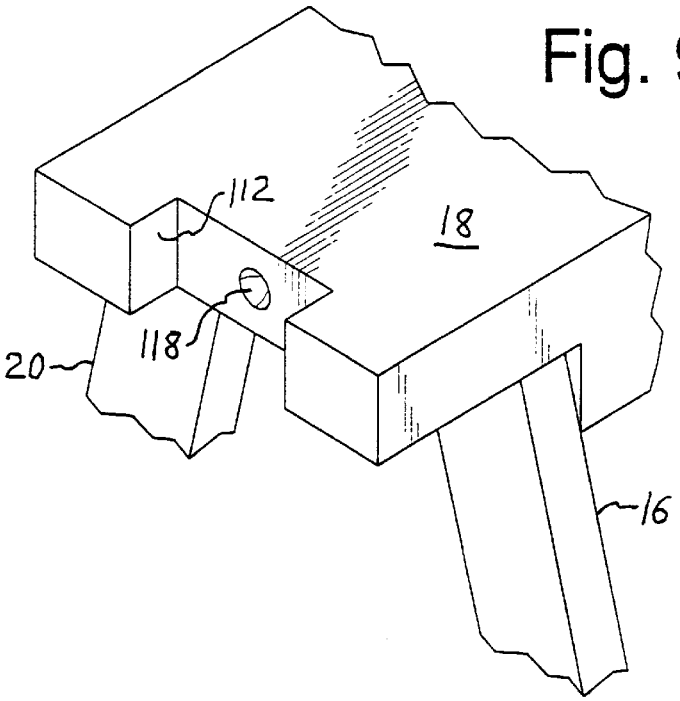
FIG. 9 is a partial cutaway view showing slidable connection between a torso assembly and a leg assembly of the drying rack shown in FIG. 7.

The leg assembly 12 will be described initially. In the first embodiment, leg assembly 12 includes a pair of generally parallel front legs 16 connected by a transversely extending upper member 18, and an articulated pair of generally parallel rear legs 20 pivotally linked to upper member 18 by a pair of pivot pins 22. The leg pairs may thus be moved apart to an angled or open condition, as best seen in FIGS. 1 and 2, to form a freestanding support structure, or they may be folded together such that the leg assembly assumes a more compact shape, as best seen in FIG. 6. Wheels 23 are preferably provided at the lower ends of front legs 16 and rear legs 20 for moving drying rack 1, particularly when the drying rack is supporting athletic equipment.

An internal slatted shelf 24 residing below upper member 18 is pivotally connected at its front end to front legs 16 and slidably connected at its rear end to rear legs 20, whereby internal shelf 24 rests in a somewhat inclined but generally horizontal position when leg assembly 12 is in its open condition and is movable to a storage position in substantial alignment with leg pairs 16 and 20 when the leg assembly is adjusted to its closed condition. Pivotal connection between internal shelf 24 and front legs 16 is represented by a pair of pivot pins 26. Sliding connection between internal shelf 24 and rear legs 20 is represented by a pair of outwardly extending followers 28 respectively mated for travel within inwardly opening slots 30 in rear legs 20, however other arrangements for sliding connection are of course possible, such as a pair of sleeves each pivotally connected to shelf 24 and arranged to slide over an associated rear leg. As will be appreciated, internal shelf 24 serves to stabilize leg assembly 12 by limiting the extent to which rear legs 20 may be opened relative to front legs 16, and also by resisting unintended closure of the leg assembly.

Another shelf, referred to herein as external shelf 32, is preferably provided on leg assembly 12 to extend in a forward direction therefrom. A rear end of external shelf 32 is pivotally connected to front legs 16 by pivot pins 34. A pair of flexible support lines 36 have one end fixed to a respective side of external shelf 32 remotely of pivot pin 34, and another end fixed to a respective front leg 16 above pivot pin 34 to support the shelf in a somewhat inclined but generally horizontal orientation opposite the slight incline of internal shelf 24, as desired.

Another preferred feature of leg assembly 12 is the provision of a pair of transversely spaced clips 38 fixed to respective rearwardly directed extension members 40 to upper member 18. Each extension member 40 is slidably received by a corresponding hole 42 within upper member 18. A resilient tab 44 is provided at a leading end of each extension member 40 and is arranged to engage an inner stepped surface in hole 42 to prevent the extension member 40 from being pulled completely out of hole 42. Tab 44 also provides frictional resistance to hold the extension member in place when it is pushed forward to be housed within hole 42.

Torso assembly 14, and its connection to leg assembly 12, will be described next. Torso assembly 14 is shown as including a transversely extending base member 50, a pair of vertical side rails 52 projecting upwardly from base member 50, a transversely extending shoulder member 54 connecting the top ends of side rails 52, a pair of arms 56 outwardly extendable from side rails 52, and a helmet member 58 upwardly extendable from shoulder member 54. Shoulder member 54 forms a transversely extending, upwardly open channel 60 defined by a front channel wall 62, a rear channel wall 64, and a channel bottom 66. A plurality of air flow holes 68, visible in FIG. 5, are preferably provided through channel bottom 66 to increase the opportunity for air circulation.

Figure 4:
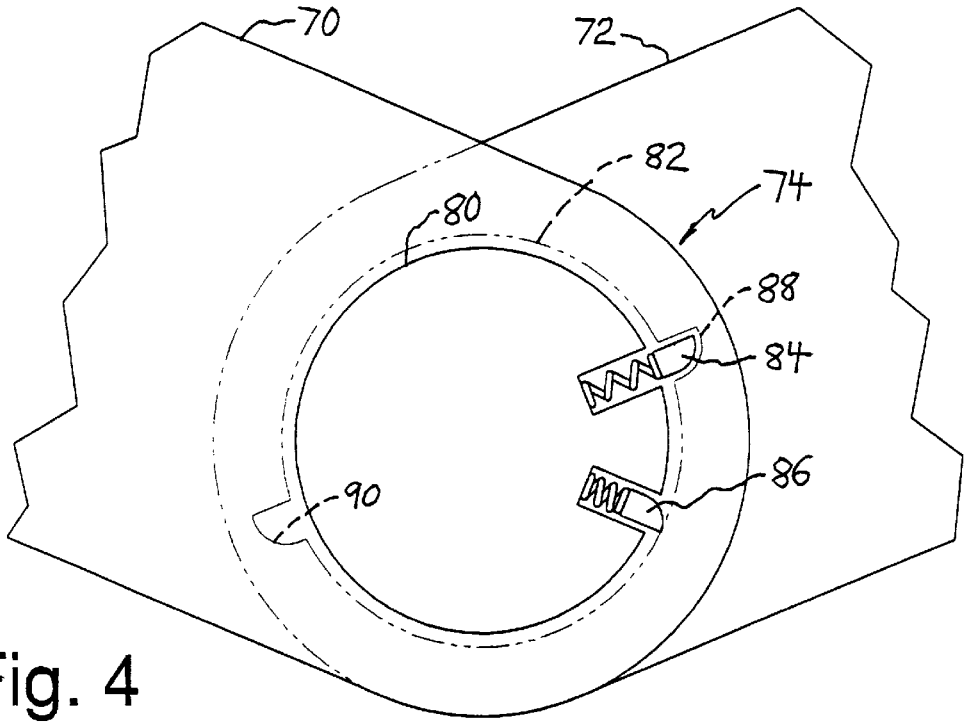
FIG. 4 is a schematic detail view of an arm joint of the drying rack.

Arms 56 each include an inner arm segment 70 and an outer arm segment 72 which are pivotally connected at adjacent ends by a first pivot means 74, shown in enlarged schematic in FIG. 4, to permit arm segments 70 and 72 to be folded together in parallel alignment or adjusted to a predetermined oblique angle. A proximal end of inner arm segment 70 is pivotally connected to a corresponding side rail 52 by a second pivot means 76 set within a slot 78 formed in side rail 52. Slot 78 is preferably sized to receive both arm segments 70 and 72 when they are folded together to a storage position.

Pivot means 74 and 76 preferably allow arm segments 70 and 72 to be releasably fixed in a predetermined position. Only first pivot means 74 is shown in FIG. 4, however it will be understood that second pivot means 76 is formed to operate in a manner similar to first pivot means 74. In a current construction, arm segments 70 and 72 are pivotally joined by a cylindrical male portion 80 extending rearwardly from inner arm segment 70 for fitted receipt within a corresponding cylindrical female portion 82 provided in outer arm segment 72. A pair of directionally biased spring plungers 84 and 86 are carried by male member 80 for singular engagement with corresponding directionally biased recesses 88 and 90. As will be understood, when arm segments 70 and 72 are pivotally adjusted to a predetermined oblique angle relative to each other, see for example FIG. 4, spring plunger 84 is aligned with recess 88 and is forced radially outward to occupy such recess. This condition prevents further movement of outer arm segment 72 in a clockwise direction, thereby holding the arm segments in a convenient drying position. Of course, outer arm segment 72 may be pivoted in a counter-clockwise direction to force spring plunger 84 radially inward and bring recess 90 into alignment with spring plunger 86 such that spring plunger 86 is forced radially outward to occupy recess 90. When the arm segments are adjusted to this pivotal condition, they are preferably in parallel alignment with each other. In this way, the arm segments may be "clicked" into an extended position or a folded position at the user's desire. With regard to second pivot means 76, a cylindrical spacer element 92 is provided within slot 78 for pivotal mating with inner arm segment 70 in a manner similar to that just described for pivotally joining the inner and outer arm segments. As will be recognized by those skilled in the art, many other constructions of pivot means 74 and 76 are possible, including indexed tooth systems and systems utilizing pivot bearings, and thus the construction of pivot means 74 and 76 used in practicing the present invention are not intended to be limited to the specific construction disclosed herein.

Figure 5:
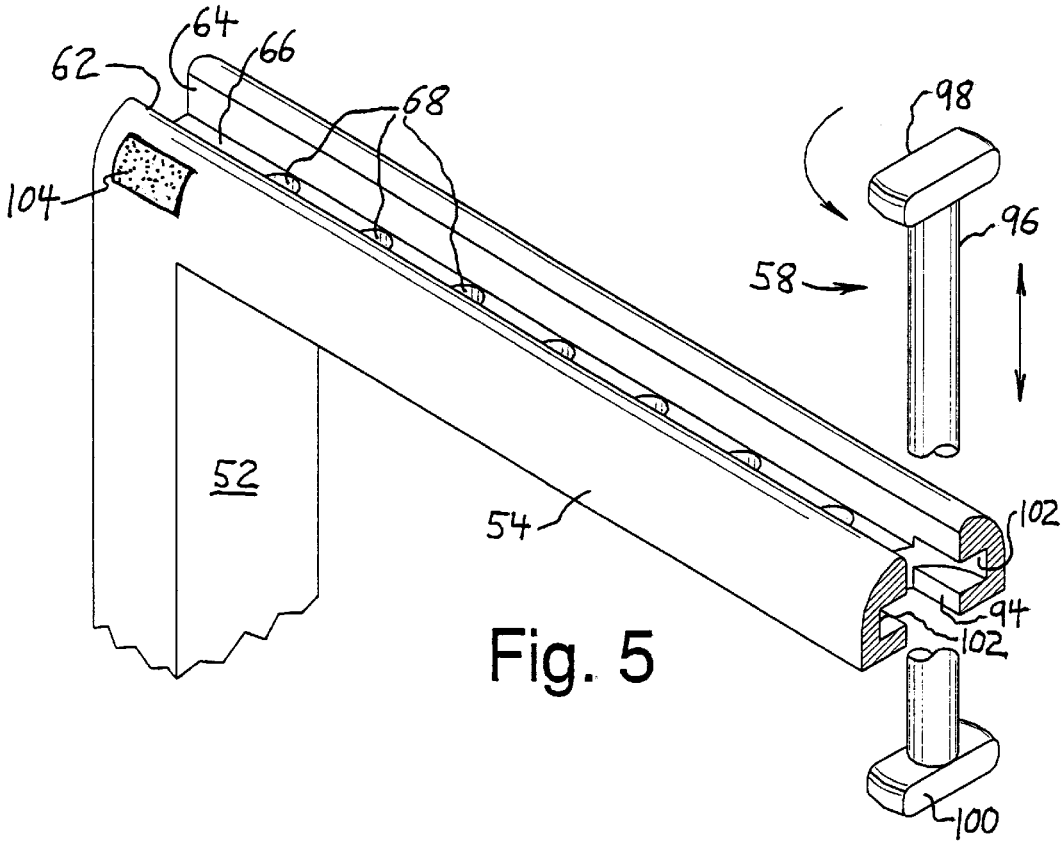
FIG. 5 is a sectioned perspective view, taken generally along the line V—V in FIG. 3, showing in detail an arrangement for connecting a helmet support member of the equipment drying rack.

Helmet member 58, as best seen in FIG. 5, is slidably mounted within a passage 94 through an intermediate portion of shoulder member 54, and more specifically through channel bottom 66. In the presently described embodiments, helmet member 58 includes an elongated round cylindrical stem 96 arranged to extend vertically through passage 94, an enlarged top portion 98 forming a right angle with respect to stem 96, and a similarly enlarged bottom portion 100 running parallel to top portion 98. Passage 94 corresponds in shape to enlarged bottom portion 100 to permit slidable movement of stem 96 and enlarged bottom portion 100 therethrough. Channel walls 62 and 64 are provided with a pair of opposing semi-circular cut-outs 102 for receiving opposite ends of bottom portion 100 when helmet member 58 has been pulled upwardly through passage 94 and rotated ninety degrees about the longitudinal axis of stem 96 in either angular direction, whereby the helmet member 58 may be set to extend upwardly from shoulder member 54 for use in holding a helmet, cap, or the like. Helmet member 58 may also be adjusted vertically to a storage position wherein enlarged top portion 98 resides within channel 60, for example with opposite ends of enlarged top portion 98 residing within cut-outs 102.

Torso assembly 14 is adjustably connected to leg assembly 12 for movement between a drying position wherein the torso assembly is supported atop the opened leg assembly with shoulder member 54 spaced vertically apart from the leg assembly and a compact storage position wherein shoulder member 54 is moved adjacent to the leg assembly. In the first embodiment, torso assembly 14 is pivotally adjustable relative to leg assembly 12 by provision of hinge means 110, such as a piano hinge or a plurality of spaced hinges, connecting base member 50 of the torso assembly to upper member 18 of the leg assembly to permit folding along a transverse axis. Consequently, torso assembly 14 may be quickly and easily adjusted to the storage position illustrated in FIG. 6 wherein shoulder member 54 is brought closely adjacent to leg assembly 12. Hook and loop fastening pads 104 are preferably provided on shoulder member 54 near the junction of side rails 52 for releasably mating with corresponding pads 106 provided on a front surface of front legs 16 to hold torso assembly 14 in place when the torso assembly is folded to its storage position. A pivotally mounted handle 25 is inset within a top surface upper member 18 for carrying the drying rack when it is adjusted to its storage position.

In a drying rack formed in accordance with a second embodiment of the present invention, shown in FIGS. 7–10 and designated generally by the reference numeral 2, torso assembly 14' is slidably adjustable relative to leg assembly 12. Torso assembly 14' is similar to torso assembly 14 of the first embodiment, however torso assembly 14' lacks base member 50 so as to enable it to slide in a vertical direction relative to leg assembly 12 by fitted arrangement of side rails 52 within cut out portions 112 provided at opposite lateral ends of upper member 18. Cooperating catch means 114 are provided between side rails 52 and upper member 18 for the purpose of releasably holding torso assembly 14' in its drying position. Catch means 114 is shown as including a pair of rounded protrusions 116 extending inwardly one from each of side rails 52 near the bottom thereof, and a pair of corresponding rounded depressions 118 one in each of cut out portions 112 opening outwardly to slidably receive protrusions 116 when torso assembly 14' is moved upwardly to its drying position. Side rails 52 flex laterally outward slightly when protrusions 116 are near alignment with depressions 118, with elastic forces bringing protrusions 116 to within depressions 118 when alignment is achieved. Protrusions 116 and depressions 118 may be molded integrally with side rails 52 and upper member 18, respectively. Alternative catch means are of course possible, for example a removable pin insertable through aligned holes in side rail 52 and upper member 18, or a spring-loaded detent mechanism. Another pair of protrusions 120 is preferably located at an upper region of side rail 52 near shoulder member 54 for releasably securing shoulder member 54 closely adjacent to upper member 18 when torso assembly 14' is adjusted to its storage position. A central passage 122 is provided through upper member 18 for accepting helmet member 58 when drying rack to is adjusted to its storage position.

The drying rack of the present invention, whether formed according to the first or the second embodiment described herein, is simple to use and readily transportable. Internal shelf 24 and external shelf 32 are available to support skates and shin guards; clips 38 and extension members 40 are intended to hold pants and stockings; shoulder member 54 and arms 56 are of course adapted to maintain a jersey in a "spread out" condition suitable for drying; arms 56 extend outward to slidably receive elbow pads and gloves; and helmet member 58 serves to support a helmet.

Figure 10:
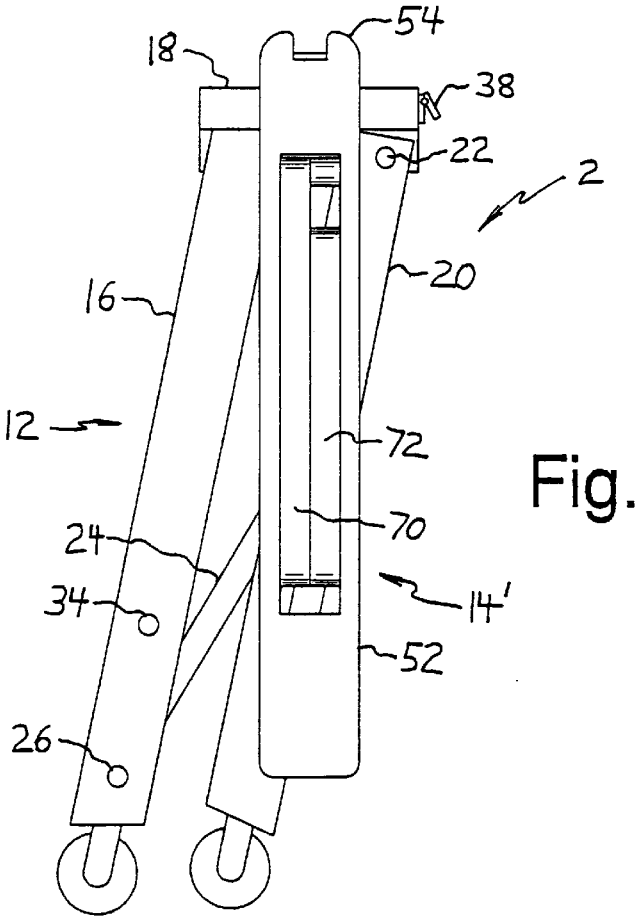
FIG. 10 is a side elevational view of the drying rack shown in FIG. 7, however illustrating the drying rack in a storage position.

When the drying rack is not in use, helmet member 58 may be rotated ninety degrees, pushed downward such that top portion 98 fits within channel 60, and then rotated another ninety degrees such that top portion is 98 is held within cut-outs 102. Arms 56 may be folded into slots 78, and extensions 40 may be pushed into holes 42. Finally, torso assembly 14 or 14' may be adjusted relative to leg assembly 12, either pivotally in the case of torso assembly 14 or slidably in the case of torso assembly 14', and leg assembly 12 may be closed incident to pivoting internal and external shelves 24 and 32 to respective generally vertical positions in alignment with the leg assembly. FIG. 6 shows drying rack 1 in its storage position, while FIG. 10 shows drying rack 2 in its storage position.

What is claimed is:

1. A drying rack for athletic equipment comprising:

a leg assembly operable between an open freestanding condition and a closed condition, said leg assembly including a transversely extending upper member; and a torso assembly connected to said leg assembly, said torso assembly including a transversely extending shoulder member, a pair of vertical side rails extending downward from opposite ends of said shoulder member for slidably engaging opposite ends of said upper member of said leg assembly, and a pair of arms connected one to each of said pair of vertical side rails;

said torso assembly being slidably adjustable relative to said leg assembly between a drying position wherein said torso assembly is supported atop said leg assembly with said shoulder member spaced apart vertically from said leg assembly, and a storage position wherein said shoulder member is adjacent to said leg assembly.

2. The drying rack according to claim 1, wherein said pair of side rails and said opposite ends of said upper member include cooperating catch means for releasably holding said torso assembly in said drying position.

3. The drying rack according to claim 2, wherein said cooperating catch means includes a pair of protrusions provided one on each of said pair of side rails, and a pair of depressions provided one on each of said opposite ends of said upper member for receiving said pair of protrusions to frictionally hold said torso assembly in said drying position.

4. A drying rack for athletic equipment comprising:

a leg assembly operable between an open freestanding condition and a closed condition, said leg assembly including a first pair of generally parallel legs connected by a transversely extending upper member and a second pair of generally parallel legs pivotally linked to said first pair of legs near said upper member;

said leg assembly further including at least one shelf adjustable supported below said upper member for movement between a drying position wherein said at least one shelf is generally horizontal and a storage position wherein said at least one shelf is generally coplanar with said leg assembly when said leg assembly is in said closed condition, said at least one shelf including an internal shelf pivotally connected to one of said first and second leg pairs and slidably connected to another of said first and second leg pairs and an external shelf pivotally connected to one of said first and second leg pairs and having a flexible shelf support line extending between said one of said first and second leg pairs and said external shelf remotely of a point of pivotal connection between said external shelf and said one of said first and second leg pairs;

a torso assembly adjustably connected to said leg assembly, said torso assembly including a transversely extending shoulder member;

said torso assembly being movable between a drying position wherein said torso assembly is supported atop said leg assembly with said shoulder member spaced apart vertically from said leg assembly, and a storage position wherein said shoulder member is adjacent to said leg assembly.

5. A drying rack for athletic equipment comprising:

a leg assembly operable between an open freestanding condition and a closed condition; and a torso assembly adjustably connected to said leg assembly, said torso assembly including a transversely extending shoulder member, a pair of vertical side rails extending downward from opposite ends of said shoulder member, and a pair of arms connected one to each of said pair of vertical side rails;

wherein each of said pair of vertical side rails includes a slot, and each of said pair of arms includes an inner arm segment pivotally connected to an associated one of said pair of side rails and an outer arm segment pivotally joined to said inner arm segment, whereby said arm is selectively extendable from said torso assembly and foldable into said slot of said associated one of said pair of side rails;

said torso assembly being movable between a drying position wherein said torso assembly is supported atop said leg assembly with said shoulder member spaced apart vertically from said let assembly, and a storage position wherein said shoulder member is adjacent to said leg assembly.

* * * * *